US012313376B2

(12) United States Patent
Toy et al.

(10) Patent No.: US 12,313,376 B2
(45) Date of Patent: May 27, 2025

(54) VIEWING OPTIC

(71) Applicant: Sheltered Wings, Inc., Barneveld, WI (US)

(72) Inventors: Seth Toy, Barneveld, WI (US); Rob Morell, Barneveld, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 0 days.

(21) Appl. No.: 17/470,613

(22) Filed: Sep. 9, 2021

(65) Prior Publication Data

US 2022/0074705 A1 Mar. 10, 2022

Related U.S. Application Data

(60) Provisional application No. 63/076,457, filed on Sep. 10, 2020.

(51) Int. Cl.
*F41G 1/30* (2006.01)

(52) U.S. Cl.
CPC ..... *F41G 1/30* (2013.01)

(58) Field of Classification Search
CPC ..... F41G 1/30
USPC ..... 42/113
See application file for complete search history.

(56) References Cited

U.S. PATENT DOCUMENTS

| | | | | |
|---|---|---|---|---|
| 7,234,265 | B1 * | 6/2007 | Cheng | F41G 1/345 42/131 |
| 11,719,924 | B2 * | 8/2023 | Morell | H02S 40/34 42/113 |
| D1,000,576 | S * | 10/2023 | Sun | D22/109 |
| 11,781,832 | B2 * | 10/2023 | Chavez | F41G 1/30 42/113 |
| 2011/0283589 | A1 * | 11/2011 | Matthews | F41G 1/30 42/113 |
| 2016/0327366 | A1 * | 11/2016 | Campean | F41G 1/16 |
| 2017/0328675 | A1 | 11/2017 | Hamilton | |
| 2020/0025516 | A1 * | 1/2020 | Mok | F41G 1/30 |
| 2021/0207928 | A1 * | 7/2021 | Brewer | F41G 1/16 |
| 2021/0293510 | A1 * | 9/2021 | Rosen | F41G 1/30 |
| 2022/0244020 | A1 * | 8/2022 | Morell | F41G 1/383 |
| 2024/0110766 | A1 * | 4/2024 | Sheets, Jr. | F41G 11/003 |

FOREIGN PATENT DOCUMENTS

| | | | |
|---|---|---|---|
| CA | 2769681 | A1 | 2/2011 |
| WO | 2019200399 | A1 | 10/2019 |

OTHER PUBLICATIONS

International Search Report and Written Opinion for International Application No. PCT/US21/49657 dated Dec. 7, 2021.
Extended European Search Report for European Patent Application No. 21867594.0 issued on Jul. 19, 2024, 8 pages.

* cited by examiner

*Primary Examiner* — Samir Abdosh
(74) *Attorney, Agent, or Firm* — Husch Blackwell LLP

(57) ABSTRACT

A viewing optic has a housing having a front side containing an optical element, a rear side containing a rear cover, a left side, a right side a top side and top side. A control is positioned on the top side. The viewing optic may be a miniature red dot sight, such as a closed red dot sight.

12 Claims, 6 Drawing Sheets

VIEWING OPTIC

CROSS-REFERENCE TO RELATED APPLICATIONS

This application is a non-provisional application of and claims priority to U.S. Provisional Patent Application No. 63/076,457 filed Sep. 10, 2020, which is incorporated herein by reference in its entirety.

FIELD

The disclosure relates to a viewing optic. In one embodiment, the disclosure relates to a miniature red dot sight for a firearm.

BACKGROUND

Miniature red dot sights (MRDSs) are non-magnifying reflector sights generally used with small firearms such as handguns and pistols. MRDSs use a reflective optical system to project light toward the user to see the target field and the illuminated red dot reticle. MRDSs can be either enclosed, in which all of the optical elements are completely encased by a housing, or open, in which at least a portion of the optical elements are not encased by a housing.

Controls for MRDSs are generally provided on the sides of the housing or top of the base of the MRDSs. These controls generally allow a user to adjust the brightness of the MRDS. Control location is very important. Controls should be quickly and easily accessible to a shooter in a variety of situations. When positioned on the side of the housing, the controls tend to favor right- or left-handed shooters, depending on which side the controls are on. Furthermore, controls can be blocked or inaccessible when a small firearm is holstered, making adjustments before drawing a firearm near impossible. While controls on the top of the base make for an ambidextrous MRDS, the space provided to reach the controls is limited, making it difficult to adjust the controls when wearing gloves. Because of the open MRDS's design, a user's finger will also block the emitter when using the controls. A user therefore cannot observe the brightness of the MRDS during adjustment.

For the reasons discussed above, having controls positioned on a MRDS housing that provide ambidextrous control and do not cause the emitter to be obscured during adjustment is a big advantage. Similarly, having controls that are accessible while a firearm is holstered is a big advantage. Thus, there is a large need for a mounting system that can address these concerns.

SUMMARY

In one embodiment, the disclosure provides a viewing optic. In accordance with embodiments of the present disclosure, a viewing optic comprises a housing having a front side containing an optical element, a rear side containing a rear cover, a left side, a right side, and a top side; and a control positioned on the top side.

In an embodiment, the control is a brightness control. In another embodiment, the control comprises at least two adjustment means. In an embodiment, the at least two adjustment means are depressible buttons. In a further embodiment, the top side comprises a recess and the control is contained within the recess. In another embodiment, the control comprises a portion of an elastomeric material.

In an embodiment, the viewing optic is a miniature red dot sight, and preferably a closed miniature red dot sight.

In another embodiment, the disclosure provides a firearm. In accordance with embodiments of the disclosure, a firearm comprises a viewing optic, the viewing optic having a housing having a front side containing an optical element, a rear side containing a rear cover, a left side, a right side, and a top side; and a control positioned on the top side.

In an embodiment, the viewing optic is a miniature red dot sight, and preferably a closed miniature red dot sight. In an embodiment, the firearm is a handgun.

In an embodiment, the control comprises at least two adjustment means. In a further embodiment, the at least two adjustment means are depressible buttons. In an embodiment, the top side comprises a recess and the control is contained within the recess. In another embodiment, the control comprises a portion of an elastomeric material.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings.

Figure 1:
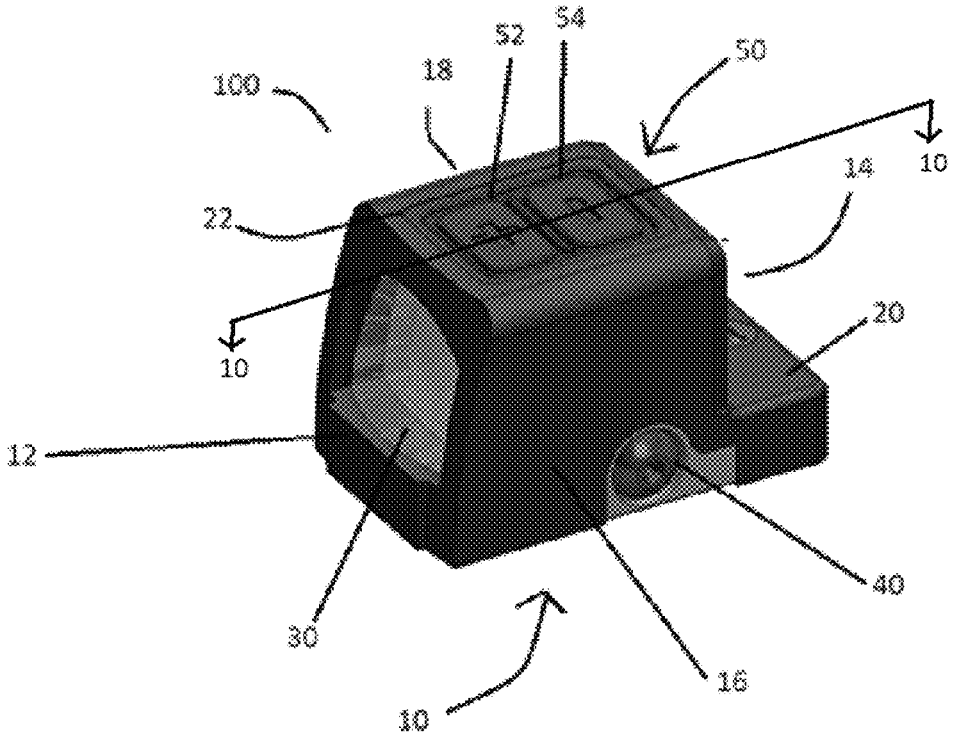
FIG. 1 is a front perspective view of a miniature red dot sight in accordance with embodiments of the disclosure.

Before explaining embodiments of the disclosure in detail, it is to be understood that the disclosure is not limited in its application to the details of construction and the arrangement of the components set forth in the following description or illustrated in the drawings. The technology of this present disclosure is capable of other embodiments or being practiced or carried out in various ways. Also, it is to be understood that the phraseology and terminology employed herein is for the purpose of description and should not be regarded as limiting.

DETAILED DESCRIPTION

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, melt index, temperature, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, relative amounts of components in a mixture, and various temperature and other parameter ranges recited in the methods.

FIGS. 1-7 illustrate a viewing optic 100, in accordance with embodiments of the present disclosure. In the particular embodiment shown, the viewing optic 100 is an miniature red dot sight (MRDS), and for purposes of this disclosure "viewing optic" and "MRDS" may be used interchangeably. When mounted to a firearm, the viewing optic 100 displays a reticle to facilitate alignment of a trajectory of the firearm with a target.

In the embodiment shown, the MRDS 100 has a housing 10 and a base 20. The housing 100 has a front side 12, rear side 14, left side 16, right side 18 and top side 22. The front side 12, rear side 14, left side 16, and right side 18 extend generally upwardly from the base 20. The front side 12 and rear side 14 extend between the left side 16 and right side 18. The top side 22 extends between the upper edges of each of the front side 12, rear side 14, left side 16, and right side 18. The resulting housing 10 contains the illumination system and other components which make the viewing optic functional. An optical element, in this case a lens 30, is contained in the front side 12 and a rear transparent cover 32, such as glass, is contained in the rear side 14. A plurality of screws, such as a mounting screw 40 and various adjustment screws 42, are provided at the base 20 of the housing 10. A battery (not shown) is also secured in the housing 10 and protected by a battery cap 45.

Figure 2:
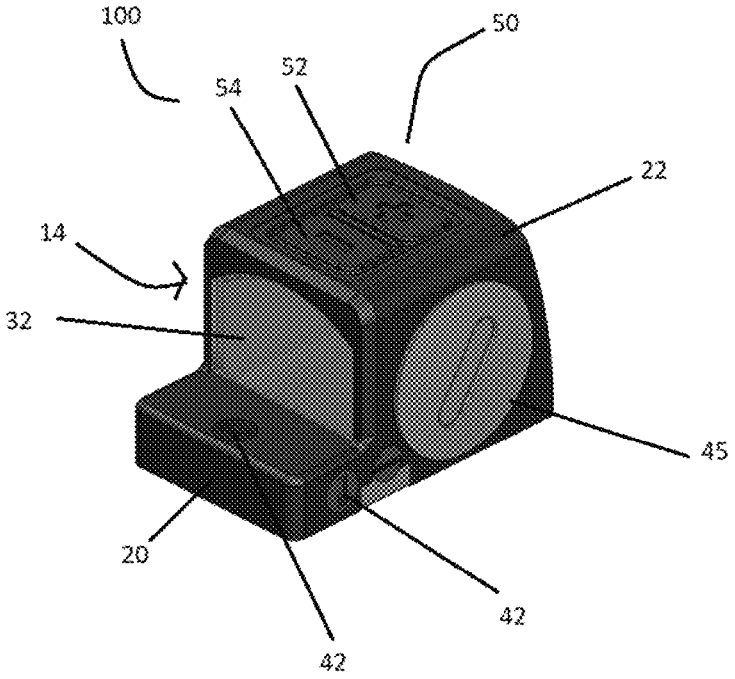
FIG. 2 is a rear perspective view thereof.
Figure 3:
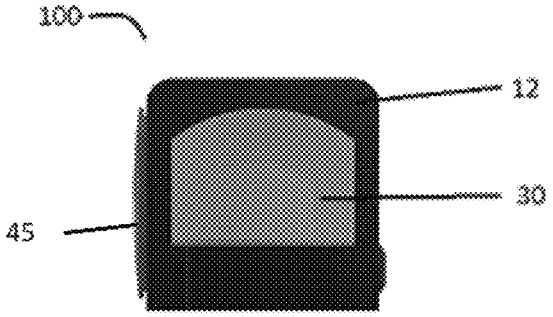
FIG. 3 is a front view thereof.
Figure 4:
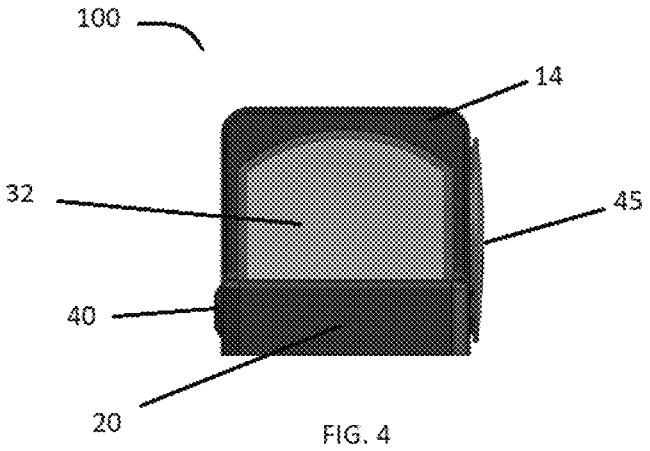
FIG. 4 is a rear view thereof.
Figure 5:
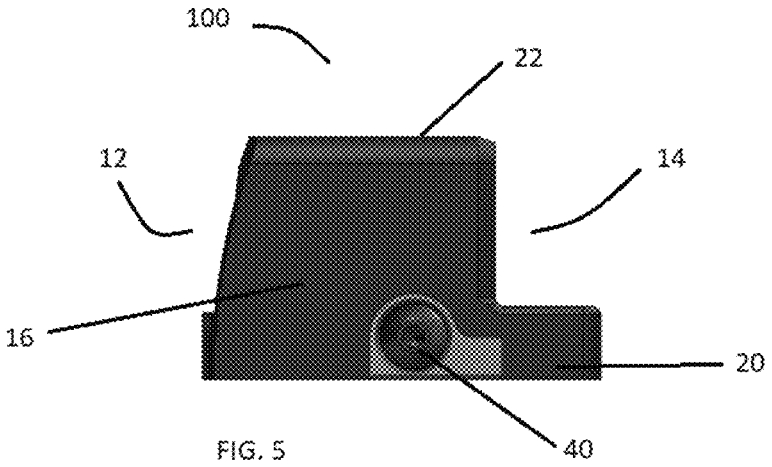
FIG. 5 is a left side view thereof.
Figure 6:
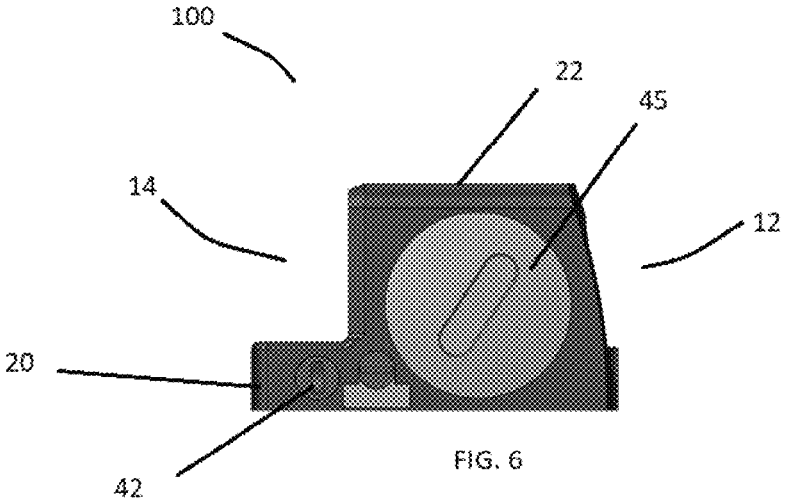
FIG. 6 is a right side view thereof.
Figure 7:
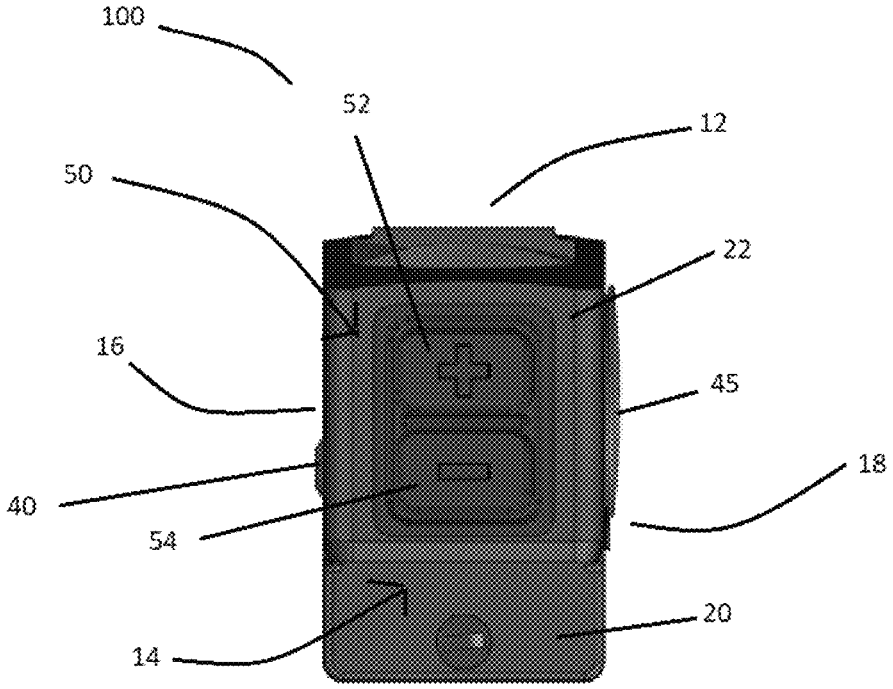
FIG. 7 is a top view thereof.

As shown with reference to FIGS. 1 and 2, the control 50 is positioned on the top side 22 of the housing 10. In the specific embodiment shown, the control 50 is provided as two depressible buttons 52, 54, one of which is configured to increase the brightness of the MRDS 100 and the other of which is configured to decrease the brightness of the MRDS 100. However, in further embodiments, the control 50 may be any type of adjustment means, such as, for example, depressible buttons, toggles, knobs, slides, etc. Further, the control 50 may include any number of such adjustment means, including but not limited to a single control, or more than two controls. Similarly, one or more of the control 50 may be configured to adjust a property of the MRDS other than brightness.

Figure 8:
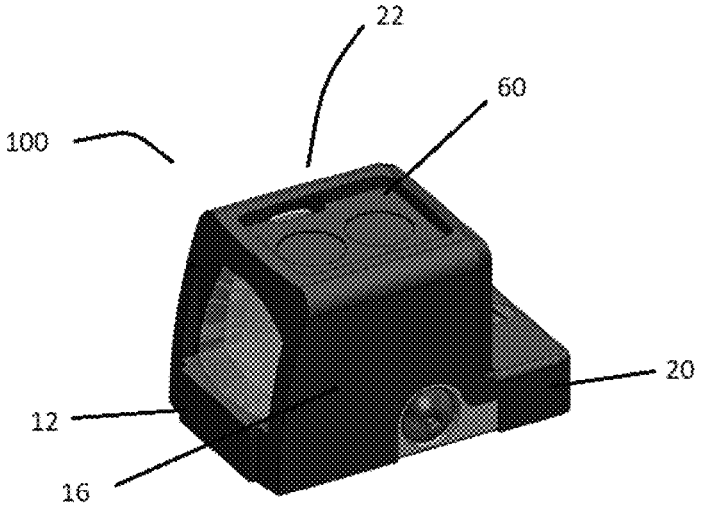
FIG. 8 is a front perspective view with the buttons removed, in accordance with embodiments of the present disclosure.
Figure 9:
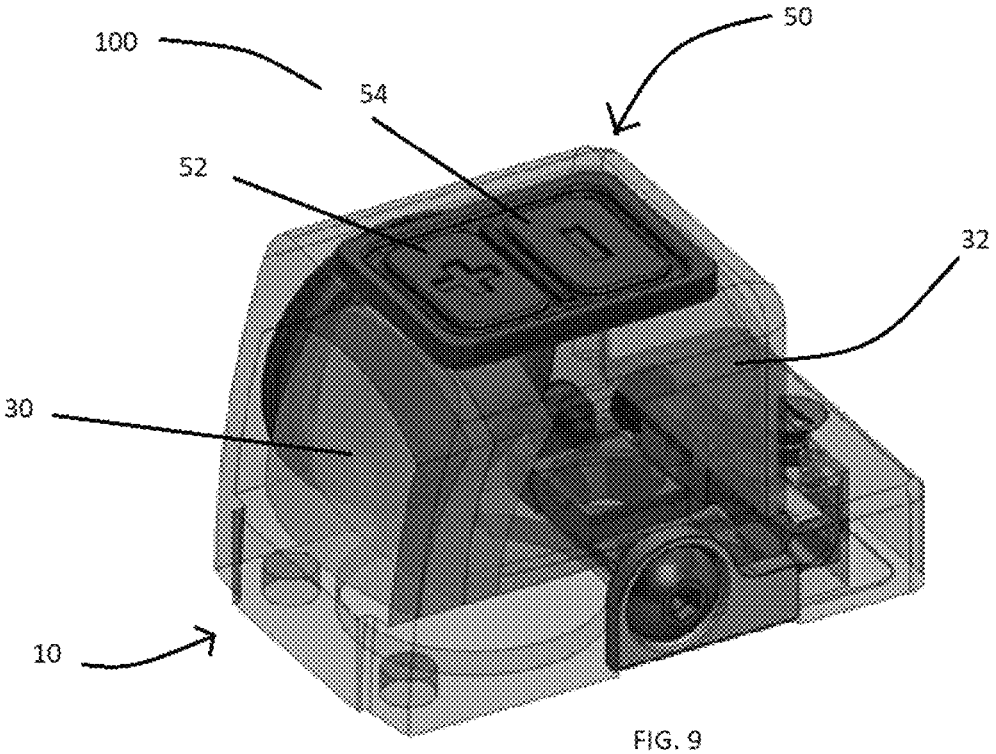
FIG. 9 is a front perspective view with the housing in phantom, in accordance with embodiments of the present disclosure.

In an embodiment, the control 50 comprises a portion of elastomeric material, or rubber-like material. As shown in FIGS. 1-2 and 8, in such an embodiment, the buttons 52, 54 are discrete portions of a rubber or silicone material contained a recess 60 of the top side 22 of the housing 10. As shown in FIG. 8, the recess 60 contains actuation portions 62, 64 which correspond to the location of the buttons 52, 54. The actuation portions 62, 64 are in electrical communication with the internal mechanisms that control the particular property being adjusted, which in the present embodiment is brightness. FIG. 9 shows the housing 10 in phantom to better see the relative positioning of the control 50, lens 30 and rear cover 32. In the embodiment shown, the housing 10 in combination with the control 50 forms a shell to protect the lens 30, rear cover 32 and internal components of the viewing optic 100. In particular, in the embodiment shown, the buttons 52, 54, being a softer material than the surrounding housing 10, additionally create a "buffer" directly above the lens 30 and rear cover 32. Should the MRDS 100 be dropped directly on its top side 22, this "buffer" redirects forces around the lens 30 and rear cover 32 and through the left and right sides 16, 18 of the housing.

By positioning the control 50 on the top side 22 of the housing 10, right handed and left handed users can equally access the control 50. This is in direct contrast to provided one or more controls on a side of the housing. Also, the control 50 on the top side 22 of the housing 10 is not blocked or crowded by other structures, allowing a user to easily access the control 50 even while wearing gloves. On existing MRDSs which have the controls positioned on the top surface of the base 20, such as, for example, with open MRDSs, any buttons or other adjustment means are generally near to the lens and/or protective cover. This makes the adjustment area very tight and difficult to operate with gloves.

Positioning the control 50 on the top side 22 of the housing also allows a user to make adjustments with the firearm in its holster, which is not always possible with controls positioned on the side or base of a MRDS. For example, if a competition shooter wants to make a brightness adjustment to compensate for some incoming cloud cover, the shooter is not able to remove the firearm from the holster to make this adjustment per the rules of the match, but would still be able to make the adjustment with the MRDS 100 disclosed herein having the control 50 on the top side 22 of the housing 100.

Figure 10:
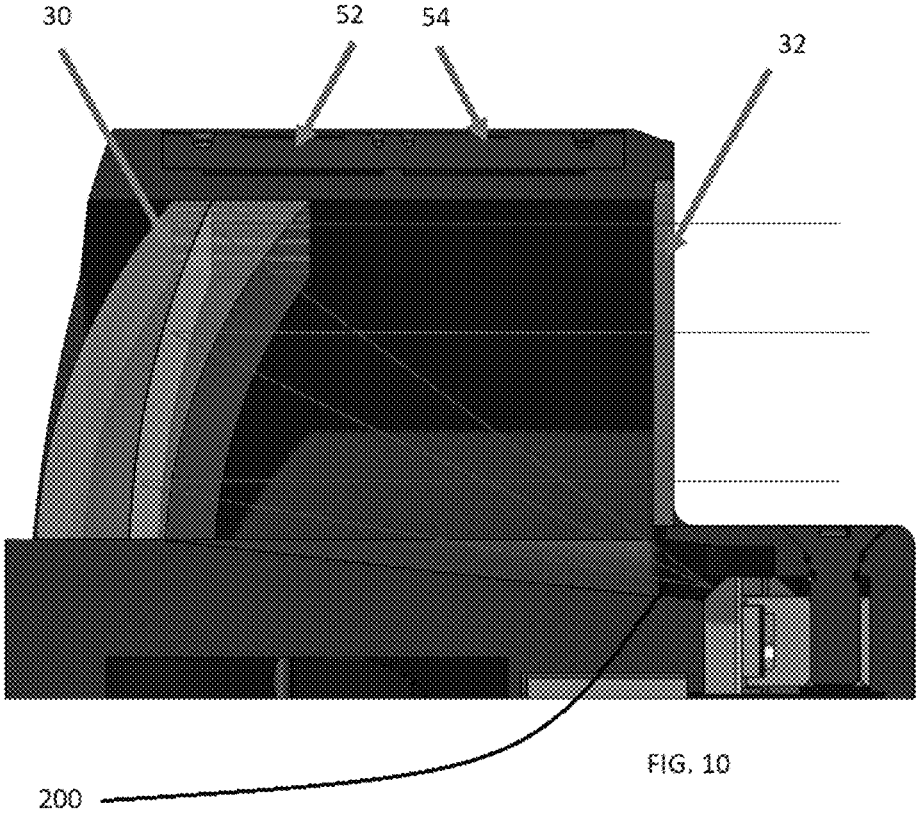
FIG. 10 is a cross-sectional view of FIG. 1 taken along line 10-10 showing the LED light path, in accordance with embodiments of the present disclosure.

FIG. 10 illustrates the light path of the LED for the MRDS 100. In the embodiment shown, the light path 200 is completely contained within the housing 10 and the MRDS 100 is a closed MRDS. In further embodiments, a portion of the light path may be exposed. In either case, it will be appreciated that positioning the control 50 on the top side 22 of the housing 10 prevents a user from blocking the light path and the user's view when making adjustments.

Although the mounting system is described with reference to a MRDS, a variety of other viewing optics may be provided with controls on a top surface, as describe herein. As used herein, the term "viewing optic" refers to an apparatus used by a shooter or a spotter to select, identify or monitor a target. The "viewing optic" may rely on visual observation of the target, or, for example, on infrared (IR), ultraviolet (UV), radar, thermal, microwave, or magnetic imaging, radiation including X-ray, gamma ray, isotope and particle radiation, night vision, vibrational receptors including ultra-sound, sound pulse, sonar, seismic vibrations, magnetic resonance, gravitational receptors, broadcast frequencies including radio wave, television and cellular receptors, or other image of the target. The image of the target presented to the shooter by the "viewing optic" device may be unaltered, or it may be enhanced, for example, by magnification, amplification, subtraction, superimposition, filtration, stabilization, template matching, or other means. The target selected, identified or monitored by the "viewing optic" may be within the line of sight of the shooter, or tangential to the sight of the shooter, or the shooter's line of sight may be obstructed while the target acquisition device presents a focused image of the target to the shooter. The image of the target acquired by the "viewing optic" may be, for example, analog or digital, and shared, stored, archived, or transmitted within a network of one or more shooters and spotters by, for example, video, physical cable or wire, IR, radio wave, cellular connections, laser pulse, optical, 802.11b or other wireless transmission using, for example, protocols such as html, SML, SOAP, X.25, SNA, etc., Bluetooth™, Serial, USB or other suitable image distribution method. In one embodiment, the viewing optic is a MRDS, and more particularly a closed MRDS.

While various embodiments of the MRDS have been described in detail, it should be apparent that modifications and variations thereto are possible, all of which fall within the true spirit and scope of the invention. With respect to the above description then, it is to be realized that the optimum dimensional relationships for the parts of the disclosed technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A viewing optic comprising:

a housing having a front side containing an optical element, a rear side containing a rear cover, a left side, a right side, and a top side, the top side having a recess with an elastomeric material; and a control positioned in the recess of the top side, the control being a discrete portion of the elastomeric material.

2. The viewing optic of claim 1, wherein the control is a brightness control.

3. The viewing optic of claim 1, wherein the control comprises at least two adjustment means.

4. The viewing optic of claim 3, wherein the at least two adjustment means are depressible buttons.

5. The viewing optic of claim 1, wherein the viewing optic is a miniature red dot sight.

6. The viewing optic of claim 5, wherein the miniature red dot sight is a closed miniature red dot sight.

7. A firearm comprising:

a viewing optic coupled to the firearm, the viewing optic having a housing having a front side containing an optical element, a rear side containing a rear cover, a left side, a right side, and a top side, the top side having a recess with an elastomeric material; and a control positioned in the recess of the top side, the control being a discrete portion of the elastomeric material, wherein the control extends from the front side to the rear side.

8. The firearm of claim 7, wherein the viewing optic is a miniature red dot sight.

9. The firearm of claim 8, wherein the viewing optic is a closed miniature red dot sight.

10. The firearm of claim 7, wherein the firearm is a handgun.

11. The firearm of claim 7, wherein the control comprises at least two adjustment means.

12. The firearm of claim 11, wherein the at least two adjustment means are depressible buttons.

* * * * *